US009296579B2

(12) United States Patent
Wakakusa et al.

(10) Patent No.: US 9,296,579 B2
(45) Date of Patent: Mar. 29, 2016

(54) TRANSPORTING APPARATUS

(71) Applicants: Keisuke Wakakusa, Nagoya (JP); Noriyuki Kawamata, Nagoya (JP); Iwane Sano, Obu (JP); Masao Mimoto, Nagoya (JP); Yasuhira Ota, Yatomi (JP); Jie Xiu, Nagoya (JP); Shingo Ito, Kasugai (JP)

(72) Inventors: Keisuke Wakakusa, Nagoya (JP); Noriyuki Kawamata, Nagoya (JP); Iwane Sano, Obu (JP); Masao Mimoto, Nagoya (JP); Yasuhira Ota, Yatomi (JP); Jie Xiu, Nagoya (JP); Shingo Ito, Kasugai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/136,154

(22) Filed: Dec. 20, 2013

(65) Prior Publication Data

US 2014/0232058 A1 Aug. 21, 2014

(30) Foreign Application Priority Data

Feb. 18, 2013 (JP) ..... 2013-028733

(51) Int. Cl.

| | |
|---|---|
| ***B41J 29/02*** | (2006.01) |
| ***B65H 5/38*** | (2006.01) |
| ***B65H 3/06*** | (2006.01) |
| ***B65H 5/06*** | (2006.01) |

(52) U.S. Cl.

CPC ..... *B65H 5/38* (2013.01); *B65H 3/0669* (2013.01); *B65H 3/0684* (2013.01); *B65H 5/062* (2013.01); *B65H 2401/115* (2013.01); *B65H 2401/15* (2013.01); *B65H 2402/30* (2013.01); *B65H 2402/40* (2013.01); *B65H 2404/6111* (2013.01); *B65H 2801/12* (2013.01)

(58) Field of Classification Search

CPC ..... B65H 3/0684
USPC ..... 400/694
See application file for complete search history.

(56) References Cited

U.S. PATENT DOCUMENTS

| | | | | |
|---|---|---|---|---|
| 4,303,013 | A * | 12/1981 | Shimodaira | B41J 29/02 101/93.22 |
| 5,230,574 | A * | 7/1993 | Namekawa | 400/120.16 |
| 6,203,224 | B1 * | 3/2001 | Kerr | B41J 29/02 400/691 |
| 6,827,436 | B2 * | 12/2004 | Nitta et al. | 347/108 |
| 6,962,412 | B2 * | 11/2005 | Koike | B41J 29/38 347/108 |

(Continued)

FOREIGN PATENT DOCUMENTS

| | | |
|---|---|---|
| JP | H06-018798 | 1/1994 |
| JP | 2011/237641 | 11/2011 |

(Continued)

OTHER PUBLICATIONS

Notice of Reasons for Rejection for JP Application No. 2013-028733 dated Jan. 5, 2016.

*Primary Examiner* — Anthony Nguyen
(74) *Attorney, Agent, or Firm* — Frommer Lawrence & Haug LLP

(57) ABSTRACT

A transporting apparatus includes a base unit made of resin, a tray configured to support a sheet, a transporting section supported by an upper portion of the base unit and configured to transport the sheet, and a feeding section supported by a lower portion of the base unit and including a feeding roller configured to contact an upper surface of the sheet supported by the tray and to feed the sheet toward the transporting section. The base unit is integrally formed with an inner-side guide which defines an inner side of a curved path which is configured to guide the sheet fed by the feeding section to the transport section.

13 Claims, 10 Drawing Sheets

(56) References Cited

U.S. PATENT DOCUMENTS

| | | | | |
|---|---|---|---|---|
| 7,029,004 | B2 * | 4/2006 | Asada et al. | 271/121 |
| 7,963,517 | B2 * | 6/2011 | Shiohara | B41J 11/485 271/9.01 |
| 8,469,506 | B2 * | 6/2013 | Uchida et al. | 347/104 |
| 2008/0012206 | A1 * | 1/2008 | Koga et al. | 271/122 |
| 2009/0189328 | A1 * | 7/2009 | Ohama | H04N 1/04 271/3.14 |
| 2010/0172221 | A1 * | 7/2010 | Osada | 369/30.85 |
| 2011/0013973 | A1 * | 1/2011 | Kusumi et al. | 403/119 |
| 2011/0280614 | A1 | 11/2011 | Yamauchi et al. | |
| 2011/0292147 | A1 * | 12/2011 | Uchino | 347/104 |
| 2012/0206552 | A1 * | 8/2012 | Uchino | 347/108 |

FOREIGN PATENT DOCUMENTS

| | | |
|---|---|---|
| JP | 2012-071564 | 4/2012 |
| JP | 2012/153146 | 8/2012 |

* cited by examiner

TRANSPORTING APPARATUS

CROSS REFERENCE TO RELATED APPLICATION

The present application claims priority from Japanese Patent Application No. 2013-028733, filed on Feb. 18, 2013, the disclosure of which is incorporated herein by reference in its entirety.

BACKGROUND OF THE INVENTION

1. Field of the Invention

The present invention relates to a transporting apparatus which transports a sheet along a transport path.

2. Description of the Related Art

A transporting apparatus which includes a transport path to transport a sheet in the apparatus, and which is capable of transporting the sheet along the transport path has been known. An image recording apparatus such as a printer and a multi-function machine is an example of such transporting apparatus. The transporting apparatus includes a pair of rollers which transports the sheet upon pinching the sheet, a feeding roller which feeds the sheet placed in a tray toward the pair of rollers, and a guide member which forms the transport path through which the sheet is transported. The pair of rollers, the feeding roller, and the guide member are installed in a frame of the transporting apparatus.

Transporting apparatuses in recent years, in many cases, have an arrangement in which a tray and the feeding roller are arranged at a bottom of the apparatus, and the pair of rollers is arranged above the tray, and the transport path extends from the tray to the pair of rollers while being curved. In an image forming apparatus having such an arrangement, a guide member which forms an inner side of a curvature of the curved transport path is arranged in an inner frame made of a metal, and the feeding roller is arranged in a main frame made of a metal, which is different from the inner frame.

SUMMARY OF THE INVENTION

However, in a case of the transporting apparatus having the abovementioned arrangement, the following is a point at issue, In a state that a front end portion of the sheet fed from the feeding roller is pinched between the pair of rollers, and a rear end portion of the sheet is pinched between the feeding roller and the tray, as the front end portion of the sheet is pulled by rotations of the pair of rollers, the sheet is pressed against the guide member which forms the inner side of the curvature of the transport path, and the sheet is stuck to the guide member. As the sheet gets stuck to the guide member, the guide member that has been pressed by the sheet shakes, and there is a possibility of a position shift of the guide member with respect to the feeding roller arranged in the main frame.

The present invention has been made in view of the abovementioned problem, and an object of the present invention is to provide a transporting apparatus, which is possible to reduce the position shift of the guide member forming an inner side of the curvature of the curved transport path through which the sheet is transported, with respect to the feeding roller which feeds the sheet to the transport path.

According to an aspect of the present invention, there is provided a transporting apparatus including a base unit made of resin; a tray configured to support a sheet; a transporting section supported by an upper portion of the base unit and configured to transport the sheet; and a feeding section supported by a lower portion of the base unit and including a feeding roller configured to contact an upper surface of the sheet supported by the tray and to feed the sheet toward the transporting section, wherein the base unit is integrally formed with an inner-side guide which defines an inner side of a curved path which is configured to guide the sheet fed by the feeding section to the transport section, According to such arrangement, the base unit is made of resin. Therefore, it is possible to reduce the cost of manufacturing the transporting apparatus, According to such arrangement, the base unit is integrally formed with the inner-side guide. En other words, the inner-side guide is integrally formed with the base unit. Therefore, in a state that a front-end portion in the transporting direction of the sheet transported through the curved path has reached the transporting section, and the feeding roller has abutted against a rear-end portion in the transporting direction of the sheet, even in a case that the sheet is pulled in the transporting direction by the transporting section and is pressed against the inner-side guide, it is possible to suppress the shaking of the inner-side guide to minimum Moreover, the feeding section is supported by the base unit which forms the inner-side guide. Therefore, even if the inner-side guide has been shaken, it is possible to suppress a shift in a relative distance between the inner-side guide and the feeding roller within a dimensional tolerance of the inner-side guide and the feeding roller. As mentioned heretofore, according to such arrangement, it is possible to maintain favorable accuracy of transporting the sheet transported through the curved path defined by the inner-side guide, while suppressing the manufacturing cost of the apparatus to be low by making the base unit of a resin material.

DESCRIPTION OF THE EMBODIMENTS

Figure 1:
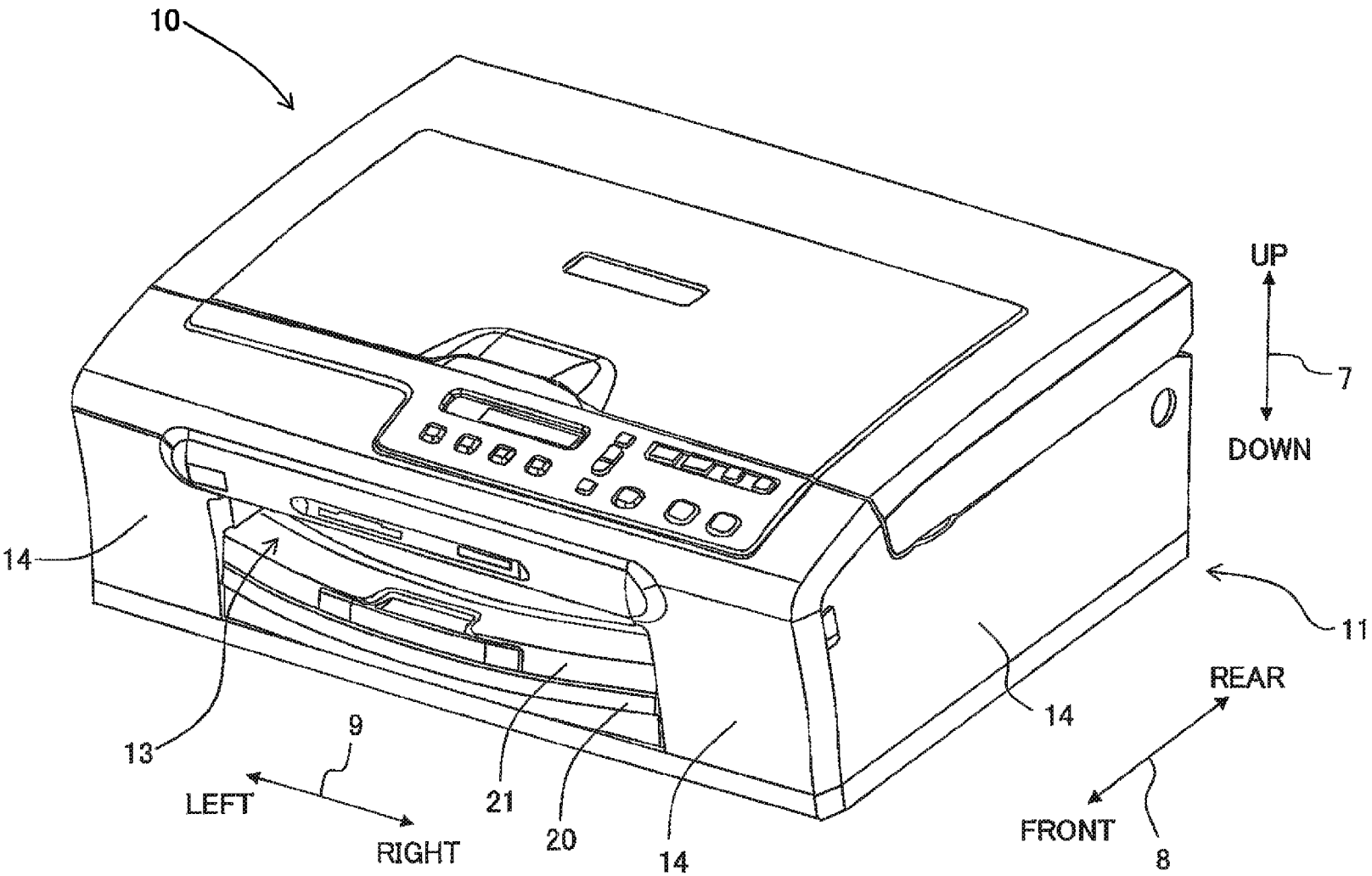
FIG. 1 is a perspective view of a multi-function device which is an example of an embodiment of the present invention.

An embodiment of the present invention will be described below by referring to the accompanying diagrams. The embodiment described below is merely an example of the present invention, and it is needless to mention that it is possible to change appropriately the embodiment of the present invention without departing from a scope of the invention. In the following description, a vertical direction 7 is defined based on a state (state in FIG. 1) in which a multi-function device 10 is installed usably, a front-rear direction 8 is defined assuming that a side on which an opening 13 is provided is a front side (front surface), and a left-right direction 9 is defined while viewing the multi-function device 10 from the front side (front surface).

<Overall Structure of Multi-Function Device 10>

As shown in FIG. 1, the multi-function device 10 is formed to be substantially thin rectangular parallelepiped shape, and a printer section Ills provided for a lower portion of the multi-function device 10. The multi-function device 10 has various functions such as a facsimile function and a print function. As the print function, the multi-function device 10 has a function of recording an image on one side of a recording paper 12 (refer to FIG. 2, an example of a sheet of the present invention) by an ink-jet method. The multi-function device 10 may have a function of recording an image on both sides of the recording paper 12. Moreover, the multi-function device 10 may record an image on the recording paper 12 by a method other than the ink-jet method, such as electrophotography.

<Feeding Tray 20>

Figure 2:
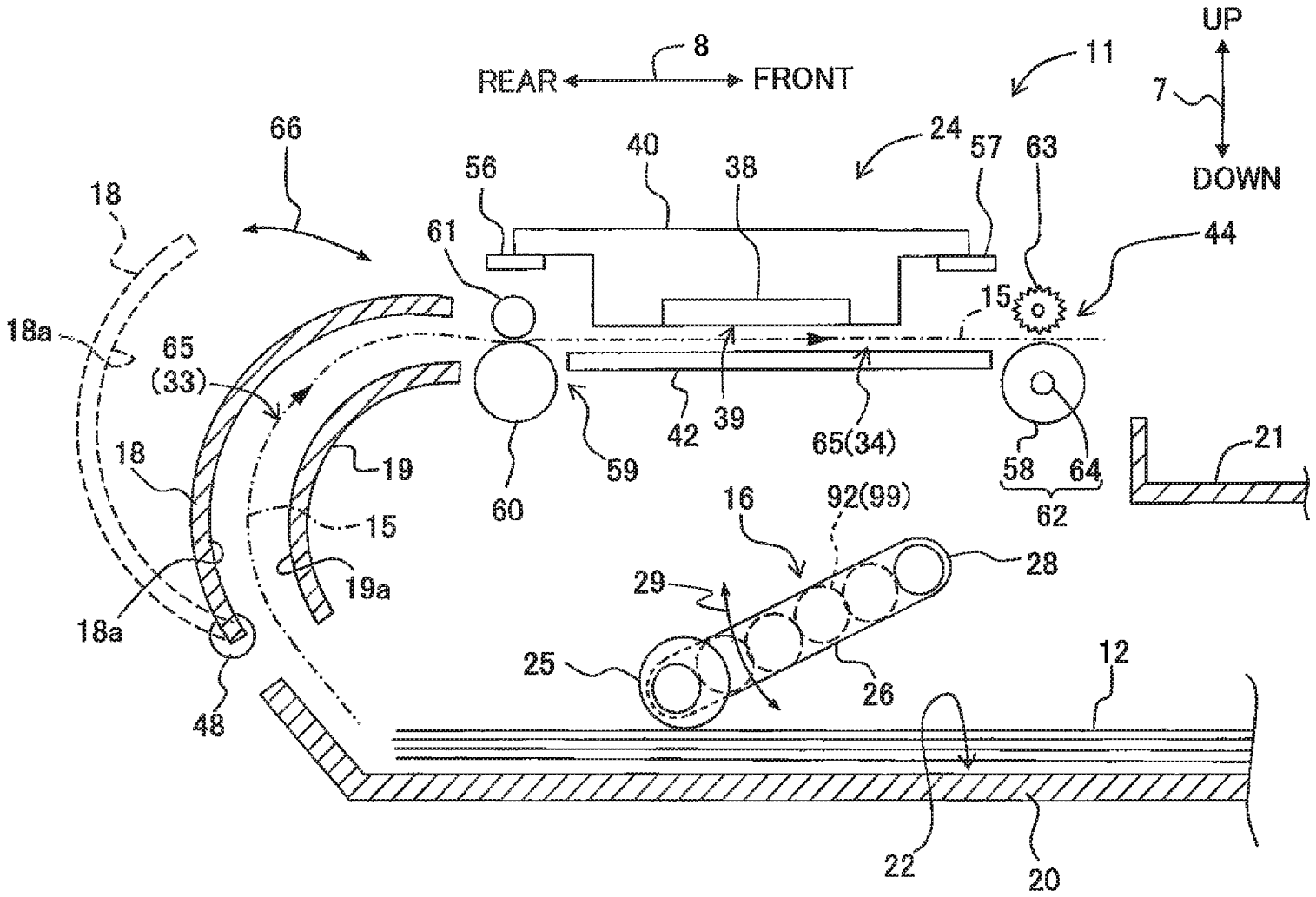
FIG. 2 is a longitudinal sectional view showing schematically an internal structure of a printer section.

As shown in FIG. 1, the opening 13 is formed in the front surface of the printer section 11. A feeding tray 20 (an example of a tray of the present invention) is movable in the front-rear direction 8 and insertable into and extractable from the printer section 11 via the opening 13. The feeding tray 20 is a box-shaped member having an upper side open. As shown in FIG. 2, recording papers 12 are placed on a base plate (bottom plate) 22 in a state of being stacked. A discharge tray 21 is supported by the feeding tray 20 at a front side as well as an upper side of the feeding tray 20. The discharge tray 21 moves integrally with the feeding tray 20 in the front-rear direction 8. The recording paper 12 having an image recorded thereon by a recording section 24 is discharged to an upper surface of the discharge tray 21. The recording section 24 will be described later.

<Feeding Section 16>

Figure 10:
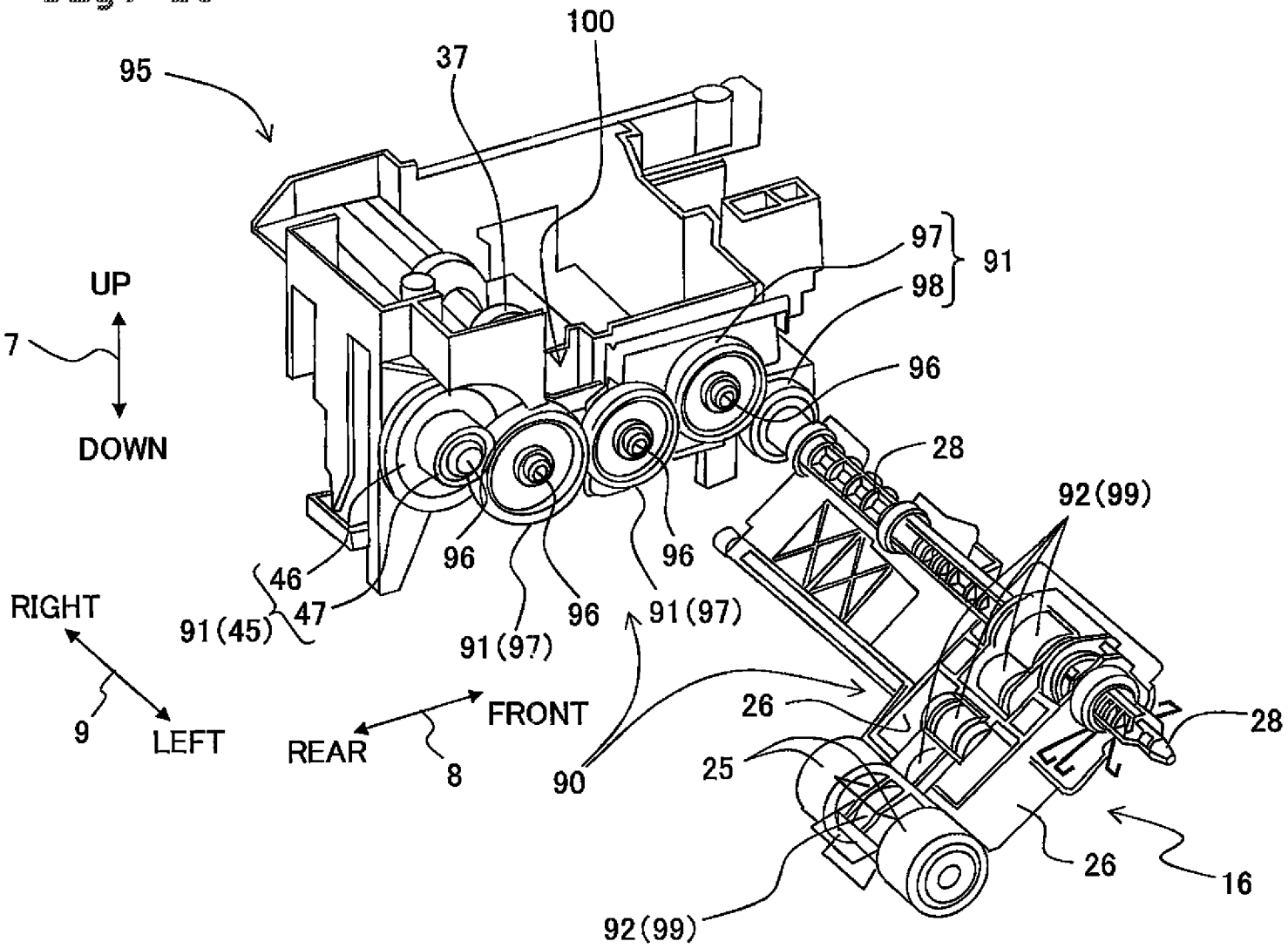
FIG. 10 is a perspective view showing a maintenance base, a transmission section, and a feeding section.

As shown in FIG. 2, a feeding section 16 is arranged above the feeding tray 20 which is inserted into the printer section Ii and below the recording section 24. As shown in FIG. 2 and FIG. 10, the feeding section 16 includes a feeding roller 25, a feeding arm 26, and a spindle 28 (an example of a shaft portion of the present invention). The feeding roller 25 is rotatably supported at a front-end portion of the feeding arm 26. The feeding arm 26 is pivoted in a direction of an arrow 29 with the spindle 28 as a center. The spindle 28 is provided for a base-end portion of the feeding arm 26 and extends in the left-right direction 9. Accordingly, the feeding roller 25 is capable of abutting against and separating from the feeding tray 20 or an upper surface the recording paper 12 placed on the feeding tray 20.

The feeding roller 25 is rotated by a driving force of a transporting motor 53 (an example of a motor of the present invention, refer to FIG. 6), which is transmitted by a transmission section 90 (refer to FIG. 10) that will be described later. Accordingly, among the recording papers 12 placed on the base plate 22 of the feeding tray 20, a recording paper 12 which is placed at the top of the recording papers 12 and against which the feeding roller 25 abuts is fed toward a transport path 65 and a pair of transporting rollers 59 arranged in the transport path 65. The pair of transporting rollers 59 will be described later.

<Transport Path 65>

As shown in FIG. 2, the transport path 65 extends from a rear-end portion of the feeding tray 20. The transport path 65 includes a curved portion 33 (an example of a curved path of the present invention) and a linear portion 34. The curved portion 33 is curved such that a rear side in the front-rear direction 8 is an outer side of a curvature and a front side in the front-rear direction 8 is an inner side of the curvature. The linear portion 34 extends in the front-rear direction 8.

The curved portion 33 is formed by a guide surface 18*a* of an outer-side guide 18 and a guide surface 19*a* of an inner-side guide 19. The guide surface 18*a* faces the guide surface 19*a* with a predetermined spacing distance therebetween. The outer-side guide 18 defines the outer side of the curved portion 33. The inner-side guide 19 defines the inner side of the curved portion 33. Each of the outer-side guide 18 and the inner-side guide 19 extends in the left-right direction 9 which is orthogonal to a paper surface in FIG. 2, In such manner, each of the guide surface 18*a* of the outer-side guide 18 and the guide surface 19*a* of the inner-side guide 19 forms at least a part of the transport path 65. As it will be described later, the inner-side guide 19 is formed integrally with a base unit 70 (refer to FIG. 3A and FIG. 3B).

The linear portion 34 is formed by the recording section 24 and the platen 42, which are facing mutually with a predetermined spacing distance therebetween, at a position at which the recording section 24 is arranged.

The recording paper 12 placed on the feeding tray 20 is transported by the feeding roller 25 to make a U-turn upward from a lower side through the curved portion 33, and reaches the pair of transporting rollers 59. In other words, the curved portion 33 guides the recording paper 12 fed by the feeding section 16 to the pair of transporting rollers 59. The recording paper 12 pinched between the pair of transporting rollers 59 is transported frontward toward the recording section 24 through the linear portion 34. When the recording paper 12 reaches right beneath the recording section 24, an image is recorded on the recording paper 12 by the recording section 24. After the image has been recorded on the recording paper 12, the recording paper 12 is transported further frontward through the linear portion 34 and is discharged to the discharge tray 21. In such manner, the recording paper 12 is transported along a transporting direction 15 indicated by an alternate dotted and dashed line in FIG. 2.

Figure 6:
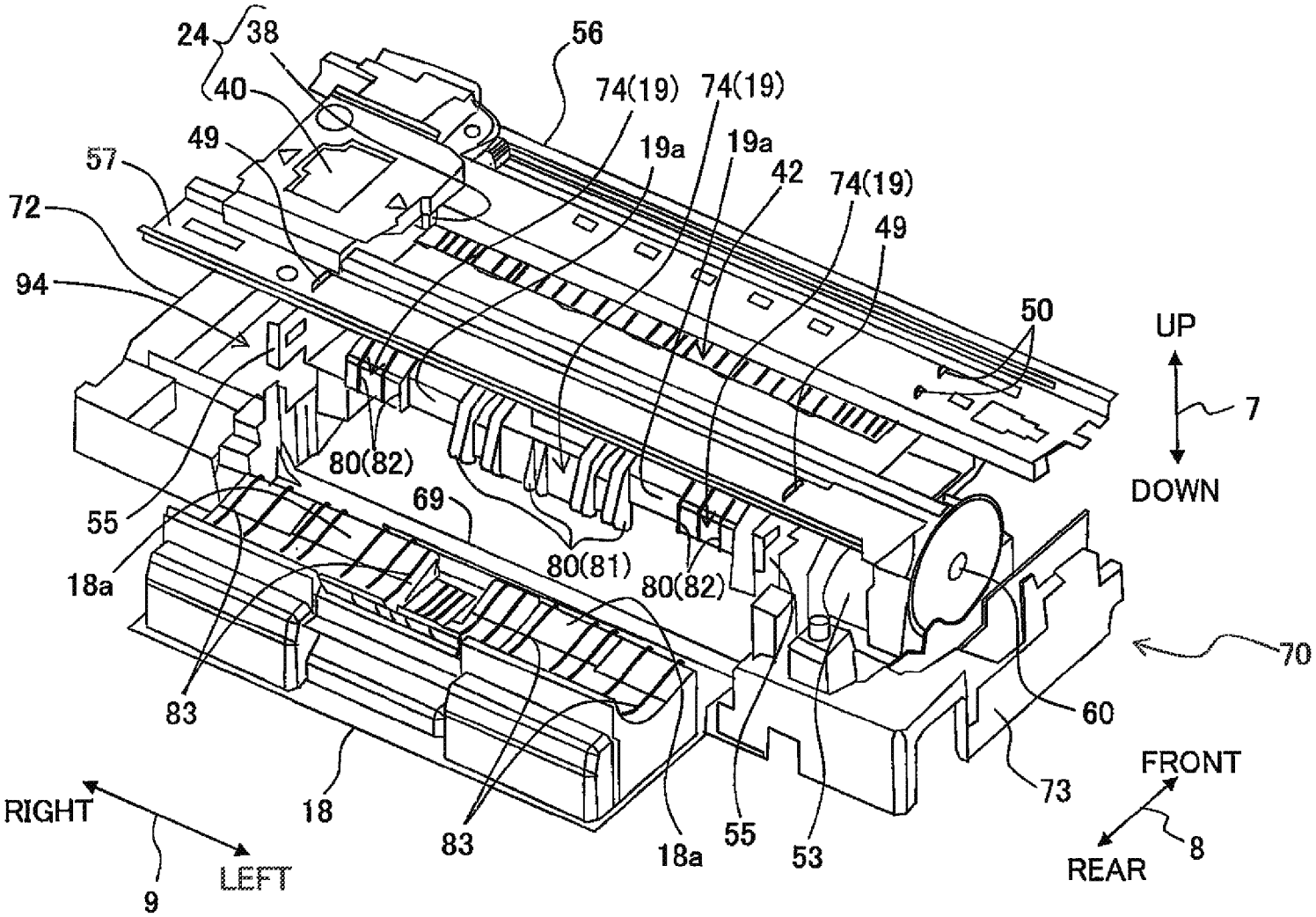
FIG. 6 is a perspective view showing a rear side and a surrounding of the rear side of the base unit when an outer-side guide is in a second state.

As shown in FIG. 6, a plurality of ribs 80 are formed on the guide surface 19*a* of the inner-side guide 19. Each rib 80 is protruded toward the outer side of the curvature of the curved portion 33. Moreover, the plurality of ribs 80 are formed at intervals in the left-right direction 9. Each rib 80 extends while being curved along the curved portion 33. The recording paper 12 fed to the curved portion 33 by the feeding section 16 is guided through the curved portion 33 while being abutted by the plurality of ribs 80.

In the left-right direction 9 (an example of a width direction), which is orthogonal to the transporting direction and which is along a surface of the recording paper 12 guided through the curved portion 33, the plurality of ribs 80 include a plurality of first ribs 81 formed at a central portion of the curved portion 33, and a plurality of second ribs 82 formed at a left-end portion and a right-end portion of the curved portion 33. A length of each first rib 81 directed toward the outer-side guide 18 is longer than a length of each second rib 82 directed toward the outer-side guide 18. In other words, in the left-right direction 9, a central portion of the inner-side guide 19 is protruded more toward the outer-side guide 18 than outer portions of the inner-side guide 19.

Figure 7:
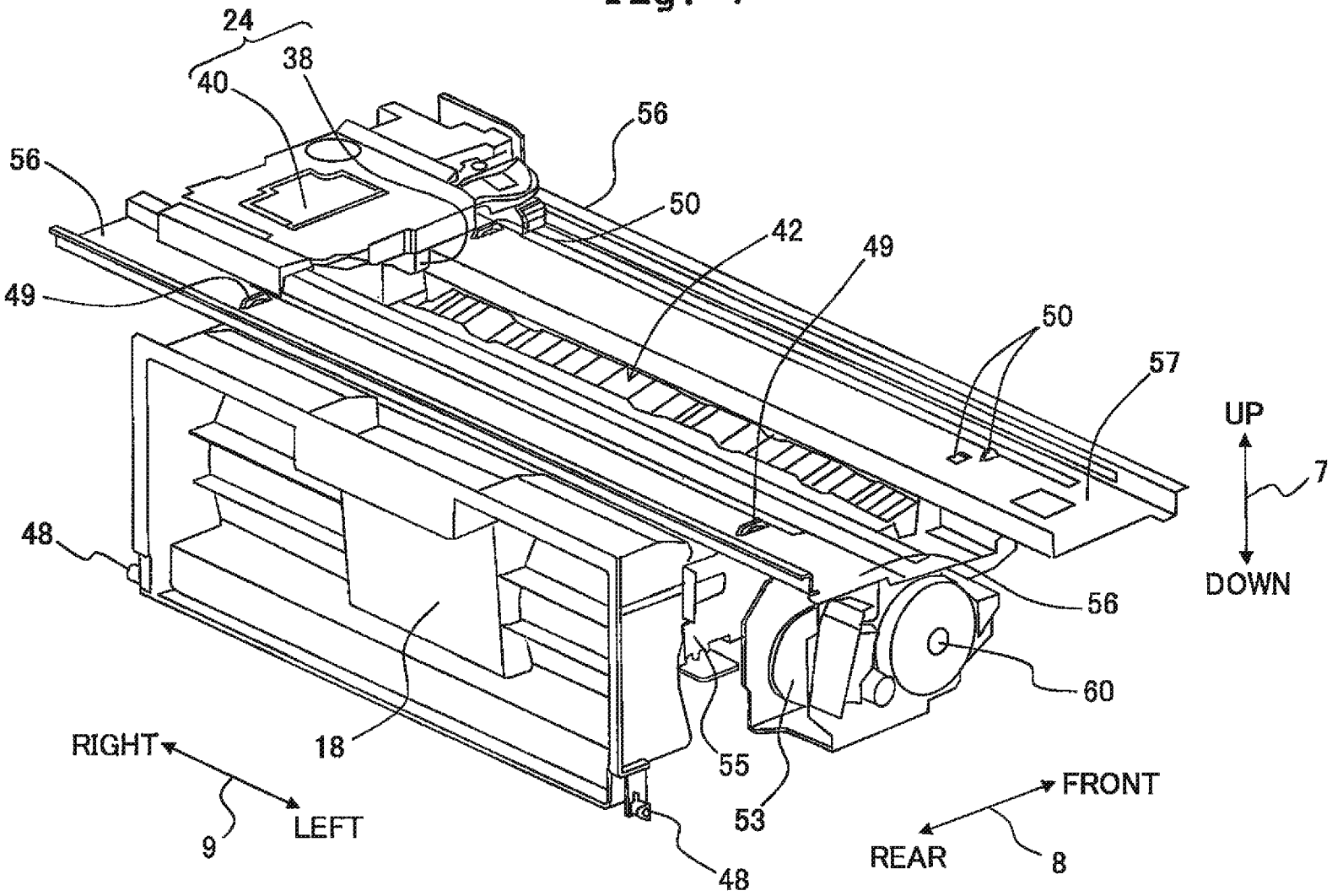
FIG. 7 is a perspective view showing a side frame, guide rails, and a surrounding of the side frame and the guide rails, when the outer-side guide is in a first state.

As shown in FIG. 6, a plurality of ribs 83 are formed on the guide surface 18*a* of the outer-side guide 18. In a state that the outer-side guide 18 is erected in the vertical direction 7 as shown in FIG. 7, each rib 83 is protruded to direct toward the inner side of the curvature of the curved portion 33, or in other words, to direct toward the guide surface 19*a* of the inner-side guide 19. Moreover, the plurality of ribs 83 are formed at intervals in the left-right direction 9. Each rib 83 extends while being curved along the curved portion 33. The recording paper 12 fed to the curved portion 33 by the feeding section 16 is guided through the curved portion 33 while being abutted by the plurality of ribs 83.

As shown in FIG. 7, shaft portions 48 are formed at a lower portion of the outer-side guide 18 in a state of being erected in the vertical direction 7. In the present embodiment, the shaft portions 48 are protrusions protruding toward outer sides from a left-end portion and a right end portion of the lower portion of the outer-side guide 18, respectively. The shaft portions 48 are inserted into holes (not shown in the diagram) formed in the base unit 70 (refer to FIG. 3 and FIG. 6), respectively. The base unit 70 forms a lower portion of the printer section H. In other words, the shaft portions 48 are pivotably supported by the base unit 70. In the present embodiment, with respect to the outer-side guide 18, only the shaft portions 48 are supported by the base unit 70. However, other portions (for example, a left surface and a right surface of the outer-side guide 18) in addition to the shaft portions 48 may be supported by the base unit 70. In other words, at least a part of the outer-side guide 18 may be supported by the base unit 70.

The printer section 11 is formed by installing an outer cover 14 (refer to FIG. 1) on the base unit 70.

The outer-side guide 18 is arranged to be pivotable in a direction of an arrow 66 with the shaft portions 48 as a center. In a first state in which the outer-side guide 18 is erected in the vertical direction 7 as shown in FIG. 7, the guide surface 18*a* of the outer-side guide 18 defines the outer side of the curvature of the curved portion 33 as shown by a solid line in FIG. 2. In a second state in which the outer-side guide 18 falls over rearward as shown in FIG. 6, the guide surface 18*a* of the outer-side guide 18 exposes the curved portion 33 to an exterior as shown by a broken line in FIG. 2. By changing a state of the outer-side guide 18 from the first state to the second state, a user of the multi-function device 10 is capable of removing the recording paper 12 jammed in the curved portion 33.

The state of the outer-side guide 18 may be changed by a method other than pivot. For instance, the outer-side guide 18 may be arranged to be detachable from the printer section 11. In this case, the state of the outer-side guide 18 changes between a first state in which the outer-side guide 18 is attached to the printer section 11; and defines the outer side of the curvature of the curved portion 33, and a second state in which the outer-side guide 18 is removed from the printer section 11 and exposes the curved portion 33 to the exterior.

<Recording Section 24>

Figure 8:
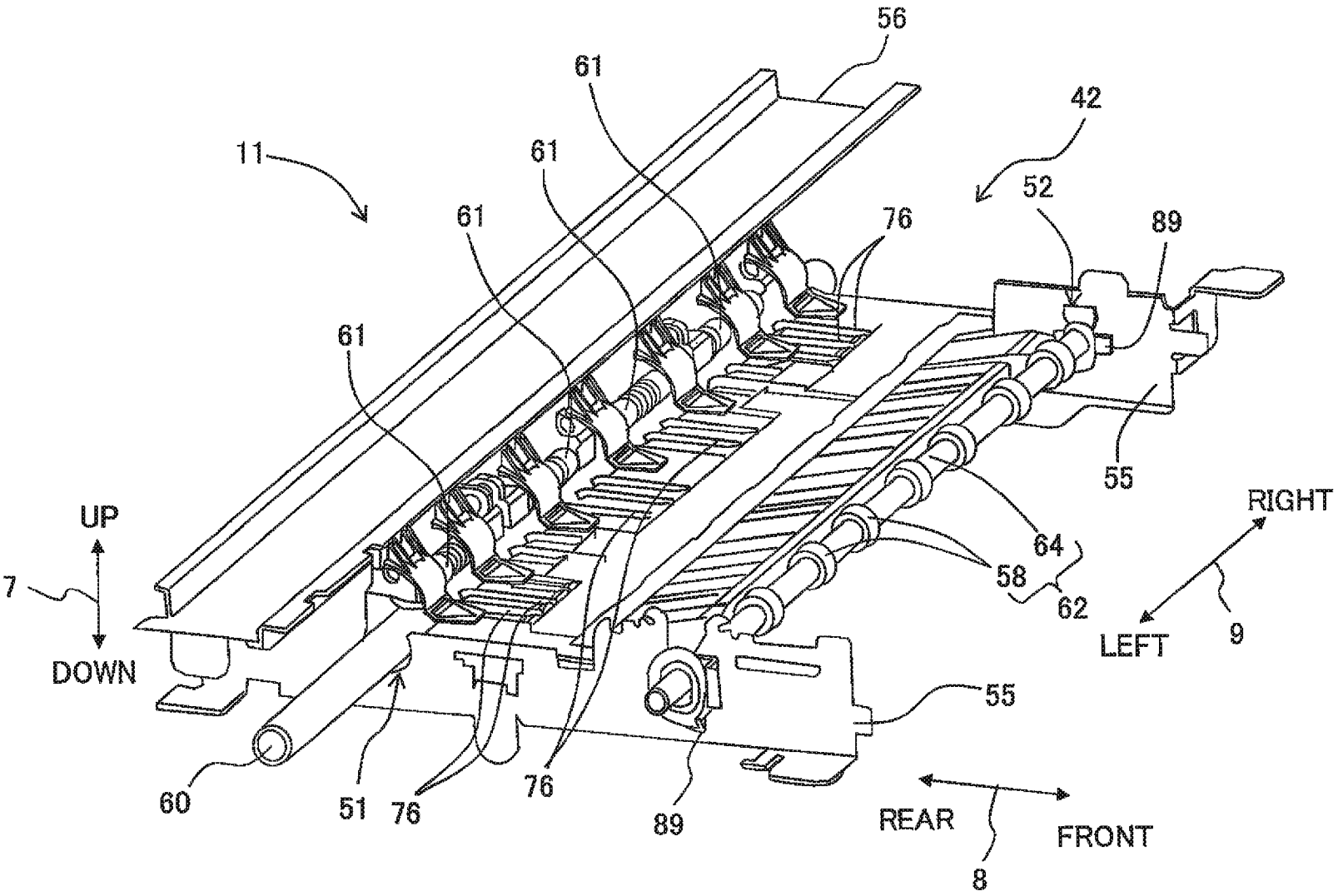
FIG. 8 is a perspective view showing the side frame, the guide rails, a platen, and a surrounding of the side frame, the guide rails, and the platen.

As shown in FIG. 2, the recording section 24 is arranged above the linear portion 34. The platen 42 is arranged at a position below the recording section 24 and facing the recording section 24. As shown in FIG. 8, the platen 42 is a member which includes ribs 76 arranged at intervals in the left-right direction 9 and each extending in the front-rear direction 8, and which supports the recording paper 12 transported through the linear portion 34 of the transport path 65 by upper ends of the ribs 76. As shown in FIG. 2, FIG. 6, FIG. 7, and FIG. 9, the recording section 24 includes a carriage 40 and a recording head 38 installed on the carriage 40.

Figure 9:
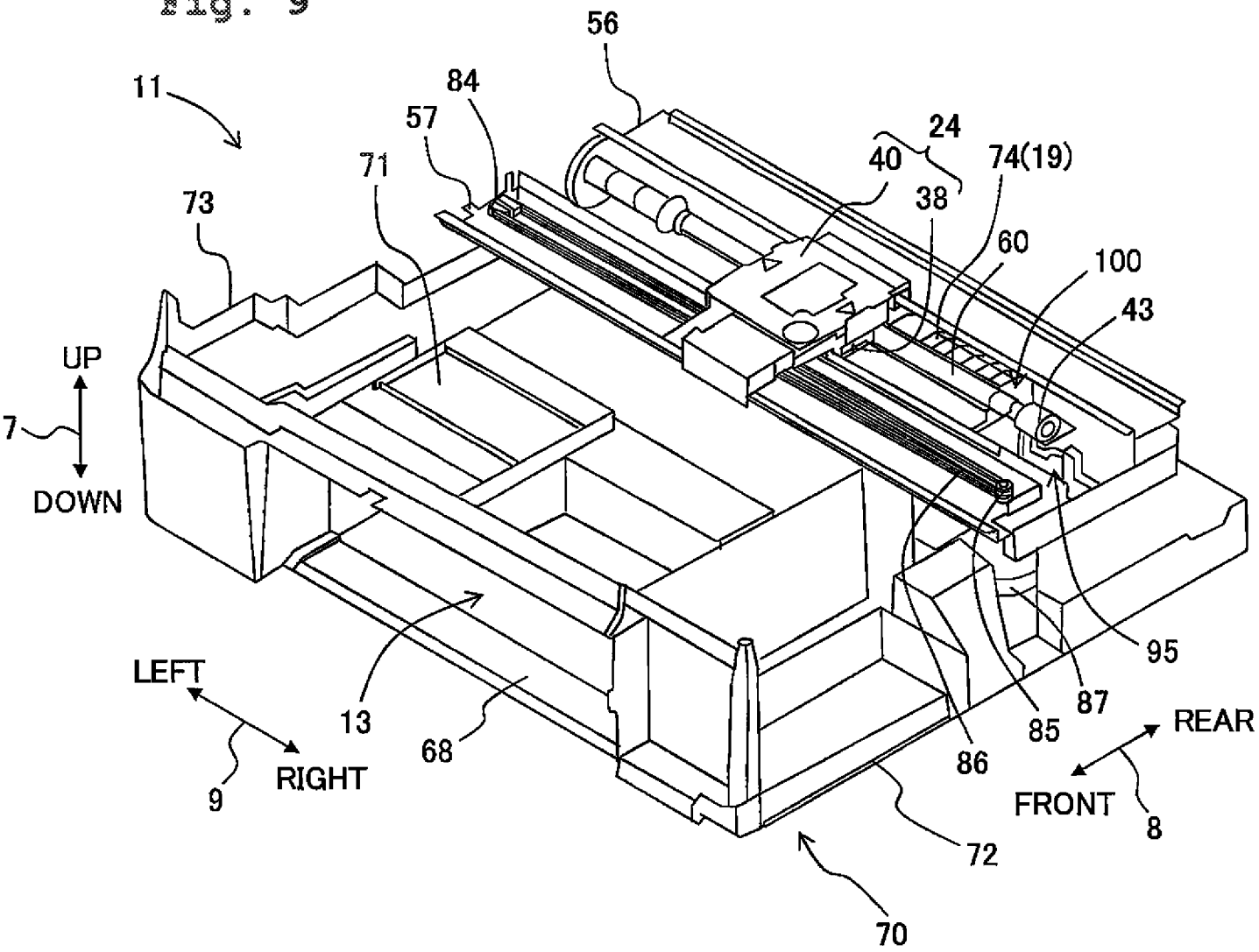
FIG. 9 is a perspective view showing the base unit, the guide rails, a recording section, and a surrounding of the base unit, the guide rails, and the recording section.

The carriage 40 is supported to be reciprocatable in the left-right direction 9 by two guide rails 56 and 57 (an example of a second support portion of the present invention) arranged at a distance in the front-rear direction 8. In other words, the guide rails 56 and 57 support the recording section 24. Concretely, the carriage 40 is arranged to be spread across the two guide rails 56 and 57. A known belt mechanism is arranged on an upper surface of the guide rail 57. As shown in FIG. 9, the belt mechanism includes pulleys 84 and 85 arranged on a left-end portion and a right-end portion of the upper surface of the guide rail 57 respectively, and a belt 86 which is put around the pulleys 84 and 85. The belt 86 is linked to the carriage 40 and a carriage-driving motor 87 which imparts a driving force to the carriage 40. As the carriage-driving motor 87 is driven, the driving force in the left-right direction 9 is transmitted to the carriage 40 via the belt mechanism. Accordingly, the carriage 40 reciprocates in the left-right direction 9.

As shown in FIG. 6 and FIG. 7, the guide rails 56 and 57 are supported by a pair of side frames 55 (an example of a first support portion of the present invention) as it will be described later.

As shown in FIG. 2, FIG. 6, FIG. 7, and FIG. 9, the recording head 38 is installed on the carriage 40. An ink is supplied from an ink cartridge (not shown in the diagram) to the recording head 38. As shown in FIG. 2, nozzles 39 are formed in a lower surface of the recording head 38. When the carriage 40 moves in the left-right direction 9, the recording head 38 jets ink droplets from the nozzles 39 toward the platen 42. Accordingly, an image is formed on the recording paper 12 which is transported in the transporting direction 15 and which is supported by the platen 42.

<Pair of Transporting Rollers 59 and Pair of Discharge Rollers 44>

As shown in FIG. 2, the pair of transporting rollers 59 is arranged at an upstream side in the transporting direction 15 of the recording head 38 of the recording section 24, in the linear portion 34 of the transport path 65. A pair of discharge rollers 44 is arranged at a downstream, side in the transporting direction 15 of the recording head 38 of the recording section 24, in the linear portion 34.

The pair of transporting rollers 59 includes a transporting roller 60 (an example of a transporting section of the present invention) which is arranged at a lower side of the linear portion 34, and pinch rollers 61 which are arranged to face the transporting roller 60 at an upper side of the linear portion 34. The transporting roller 60 is a hollow and circular cylindrical shaped member extending in the left-right direction 9. As shown in FIG. 8, the pinch rollers 61 are provided at intervals in the left-right direction 9. Each of the pinch rollers 61 is pressed against the transporting roller 60 by an elastic member (not shown in the diagram).

As shown in FIG. 2, the pair of discharge rollers 44 includes a discharge roller 62 (an example of a discharge section of the present invention) which is arranged at the lower side of the linear portion 34, and spurs 63 which are arranged to face the discharge roller 62 at the upper side of the linear portion 34. As shown in FIG. 8, the discharge roller 62 includes a shaft portion 64 which extends in the left-right direction 9, and a plurality of roller portions 58 which are fitted to the shaft portion 64 at intervals in the left-right direction 9 to cover the shaft portion 64. The spurs 63 are arranged at intervals in the left-right direction 9. Each spur 63 is provided at a position facing one of the roller portions 58 of the discharge roller 62. Each of the spur 63 is pressed against one of the roller portions 58 of the discharge roller 62 by an elastic member (not shown in the diagram).

The transporting roller 60 rotates by the driving force transmitted from the transporting motor 53 (refer to FIG. 6) performing normal rotation and reverse rotation. As the transporting roller 60 performs normal rotation by the driving force applied from the transporting motor 53 in a state that the recording paper 12 is pinched between the pair of transporting rollers 59, the recording paper 12 is transported to the platen 42, or in other words, is transported in the transporting direction 15. Whereas, as the transporting roller 60 performs reverse rotation by the driving force applied from the transporting motor 53, the recording paper 12 is transported in a direction opposite to the direction during the normal rotation of the transporting roller 60, or in other words, in a direction opposite to the transporting direction 15.

Moreover, a belt which is not shown in the diagram is put around the discharger roller 62 and the transporting roller 60. Accordingly, the driving force of the transporting roller 60 is transmitted to the discharge roller 62. As the discharge roller 62 is rotated by the driving force in a direction of the normal rotation applied from the transporting roller 53 via the transporting roller 60 in a state that the recording paper 12 is pinched between the pair of discharge rollers 44, the recording paper 12 is transported in the transporting direction 15 by the pair of discharge rollers 44. Accordingly, the recording paper 12 is discharged on the discharge tray 21.

The transporting roller 60 and the discharge roller 62 are supported by the pair of side frames 55 as it will be described later. Moreover, the transmission of the driving force from the transporting motor 53 to the transporting roller 60 will be described later.

<Base Unit 70>

Figure 3B:
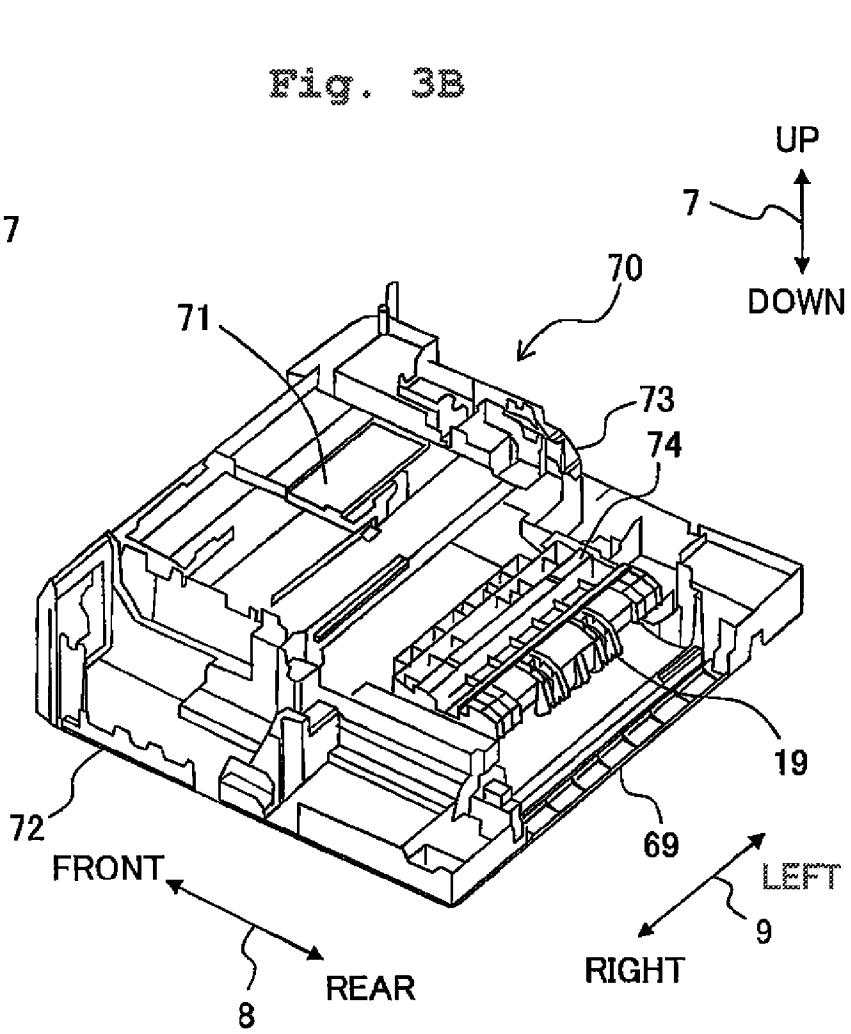
FIG. 3B is a perspective view of the base unit.
Figure 3A:
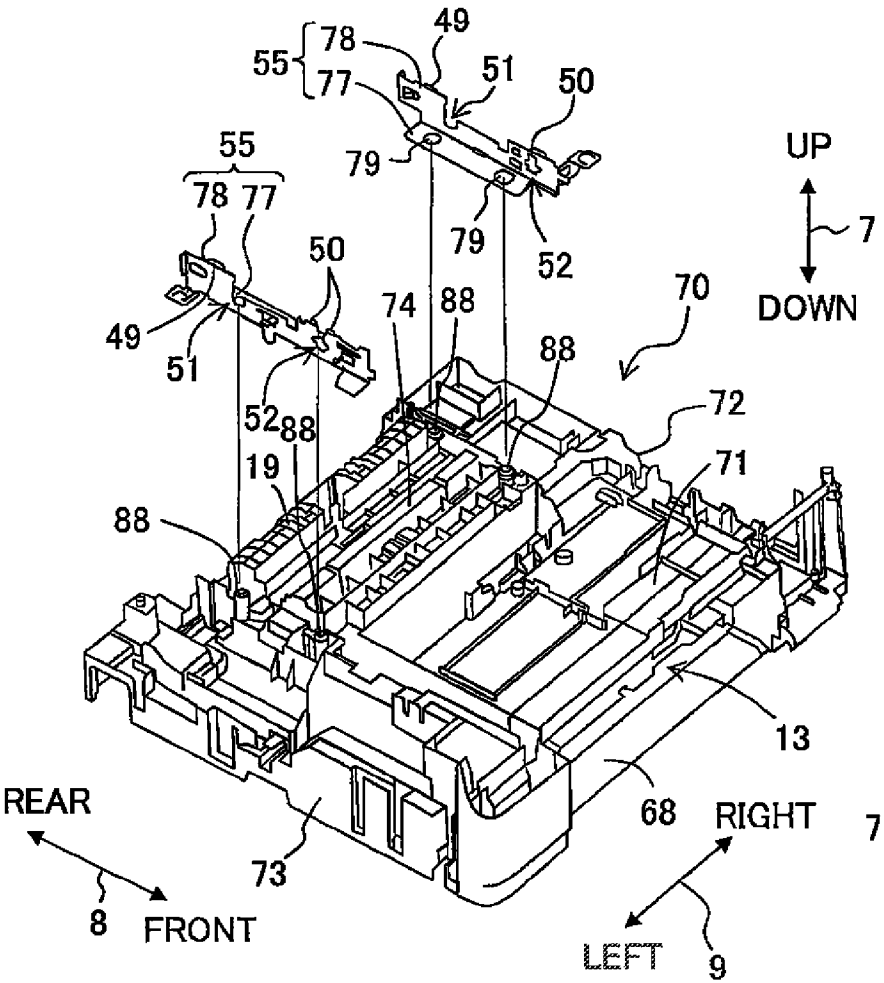
FIG. 3A is a perspective view of a base unit and a side frame.

As shown in FIG. 3A and FIG. 3B, the base unit 70 is a frame which forms a lower portion of the printer section 11. The base unit 70 is integrally molded as a single piece by using a resin material such as PBT/ABS (polybutylene-terephthalate acrylonitrile-butadiene-styrene) resin. The base unit 70 includes an upper front portion 71, a right-side portion 72 which is joined to the upper front portion 71 at a right side of the upper front portion 71, a left-side portion 73 which is joined to the upper front portion 71 at a left side of the upper front portion 71, a lower front portion 68 which is joined to a lower front end portion of the left-side portion 73 and is also joined to a lower front end portion of the right-side portion 72, a lower rear portion 69 which is joined to a lower rear end portion of the left-side portion 73 and is also joined to a lower rear end portion of the right-side portion 72, and an upper rear portion 74 which is arranged at from the back of the upper front portion 71 with a spacing distance therebetween. A right end of the upper rear portion 74 is joined to the right-side portion 72, and a left end of the upper rear portion 74 is joined to the left-side portion 73.

Figure 4:
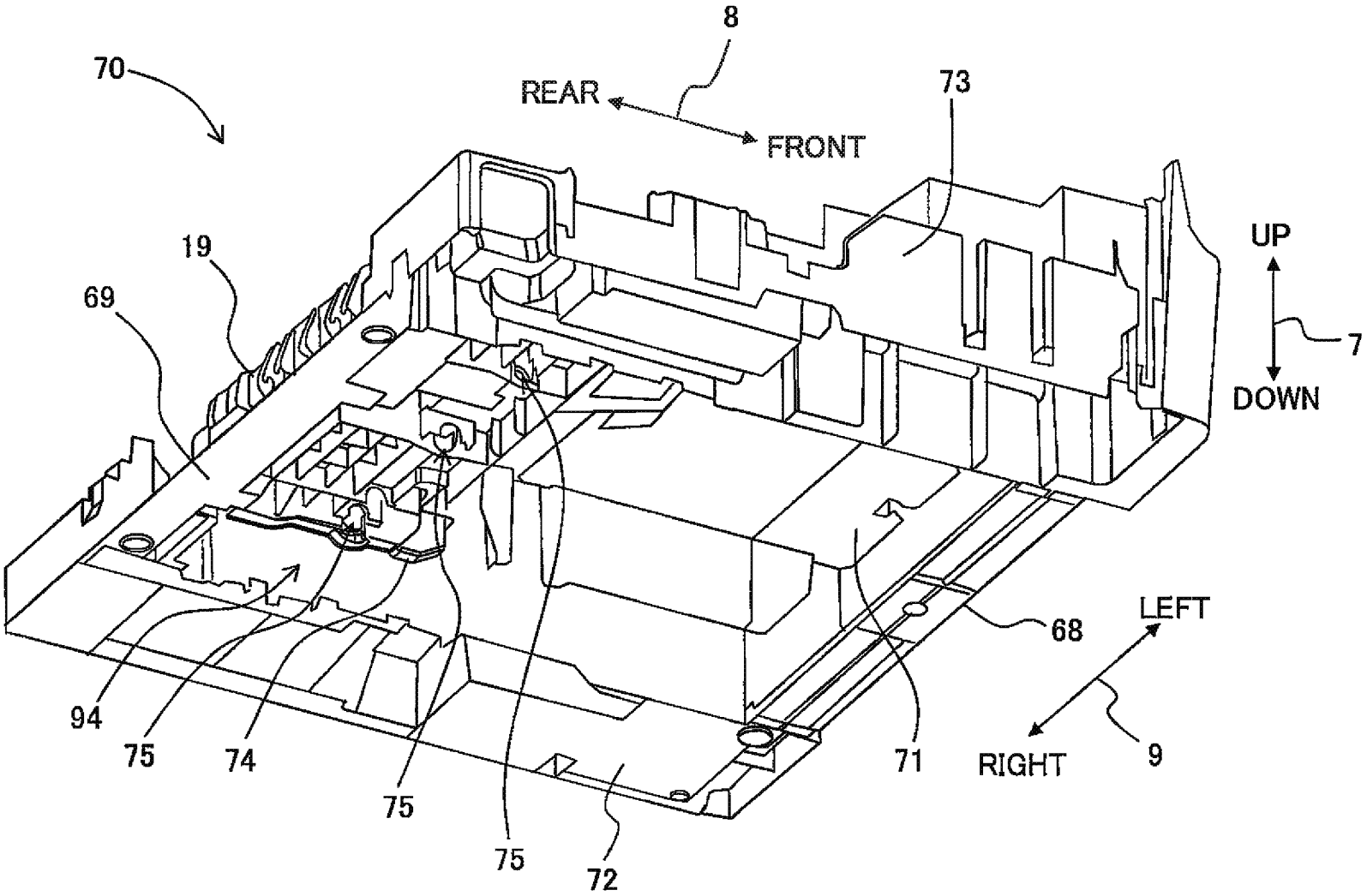
FIG. 4 is a perspective view of the base unit when viewed from a lower side.
Figure 5:
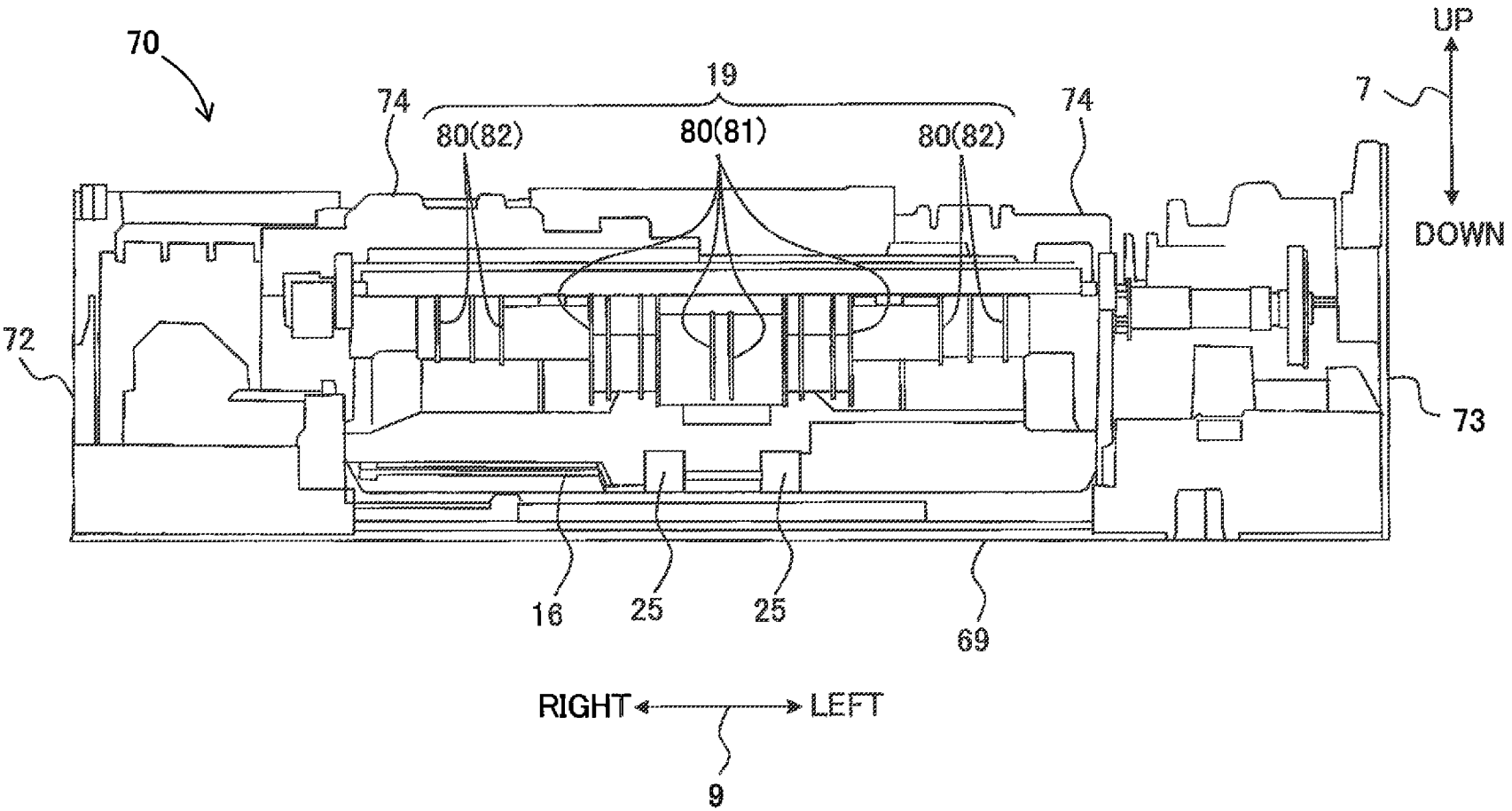
FIG. 5 is a rear view of the base unit and a feeding section.

As shown in FIG. 3A, the opening 13 through which the feeding tray 20 is inserted into and extracted from the printer section 11, is formed by the upper front portion 71, the right-side portion 72, the left-side portion 73, and the lower front portion 68, As shown in FIG. 4, a large number of ribs are formed on a lower side of the upper rear portion 74. Moreover, openings 75 in the left-right direction 9 are formed in some of the ribs. The spindle 28 of the feeding section 16 is inserted into the openings 75. Accordingly, the spindle 28 is rotatably supported by a lower side of the upper rear portion 74 of the base unit 70. In other words, the feeding section 16 is supported by a lower portion of the upper rear portion 74 of the base unit 70 as shown in FIG. 5.

As shown in FIG. 3 and FIG. 6, a rear surface of the upper rear portion 74 of the base unit 70 is curved. Moreover, this curved rear surface forms the abovementioned guide surface 19*a* of the inner-side guide 19. In other words, the inner-side guide 19 is integrally formed (molded) with the upper rear portion 74 of the base unit 70.

Although it is not shown in the diagram, a hole into which the shaft portion 48 of the abovementioned outer-side guide 18 is to be inserted is formed in the lower rear-end portion of the right-side portion 72 of the base unit 70 and the lower rear-end portion of the left-side portion 73 of the base unit 70, Moreover, by the shaft portion 48 of the abovementioned outer-side guide 18 being inserted into the hole, the right-side portion 72 and the left-side portion 73 of the base unit 70 support the outer-side guide 18 pivotally.

<Side Frame 55>

As shown in FIG. 3 and FIG. 6, the pair of side frames 55 is arranged at an upper side of the base unit 70, More elaborately, the pair of side frames 55 is installed to face mutually in the left-right direction 9 on a right end portion and a left end portion of the upper rear portion 74. The side frame 55 is made of a metal. Moreover, each side frame 55 is a member in the form of a plate bent to about 90 degrees. In other words, in a state of being installed on the upper rear portion 74, each side frame 55 includes a bottom portion 77 in the form of a plate spread in the front-rear direction 8 and the left-right direction 9, and a side portion 78 in the form of a plate erected upward from the bottom portion 77 and spread in the vertical direction 7 and the front-rear direction 8.

A hole 79 which penetrates the bottom portion 77 in the vertical direction 7 is formed in the bottom portion 77. Moreover, a hole 88 which penetrates the upper rear portion 74 in the vertical direction 7 is formed at a position, on the upper rear portion 74, corresponding to the hole 79 of the bottom portion 77 in a state that the side frame 55 is installed on the upper rear portion 74 of the base unit 70. By inserting a screw (not shown in the diagram) along the vertical direction 7 in the hole 79 of the bottom portion 77 and the hole 88 of the upper rear portion 74, each side frame 55 is fixed to the upper rear portion 74 of the base unit 70. In other words, the base unit 70 and each side frame 55 are fastened in the vertical direction 7 by the hole 79 in the bottom portion 77, the hole 88 in the upper rear portion 74, and the screw. The hole 79 in the bottom portion 77, the hole 88 in the upper rear portion 74, and the screws are an example of a fastener member of the present invention.

As shown in FIG. 3 and FIG. 8, a notch 51 is formed in each of the pair of side frames 55. The notch 51 is cut in a rear portion of the side frame 55, in the form of a circular arc directed downward from an upper end of the side frame 55. A bearing (not shown in the diagram) is fitted in the notch 51. The transporting roller 60 is inserted into the bearing 60. In FIG. 8, the bearing is omitted. In such manner, the pair of side frames 55 supports the transporting roller 60. Here, the pair of side frames 55 is arranged at the upper portion of the base unit 70 as described above. In other words, the transporting roller 60 is arranged above the base unit 70 via the pair of side frames 55.

Moreover, as shown in FIG. 3 and FIG. 8, a notch 52 is formed in each of the pair of side frames 55. The notch 52 is an opening formed in a front portion of each side frame 55. A bearing 89 (refer to FIG. 8) is fitted in the notch 52. The discharge roller 62 is inserted into the bearing 89. In such manner, the pair of side frames 55 supports the discharge roller 62.

Moreover, as shown in FIG. 6 and FIG. 7, the guide rails 56 and 57 are supported by the pair of side frames 55. As shown in FIG. 3A, protrusions 49 and 50 protruded upward from the upper end portion are formed on each side frame 55. The protrusion 49 is formed on a rear portion of the side frame 55. The protrusion 50 is formed on a front portion of the side frame 55. On the other hand, an opening of a size corresponding to the protrusion 49 is formed in the guide rail 56, and the protrusion 49 of the side frame 55 is engaged in the opening. Accordingly, the guide rail 56 is supported by the pair of side frames 55. Moreover, an opening of a size corresponding to the protrusion 50 is formed in the guide rail 57, and the protrusion 50 of the side frame 55 is engaged in the opening. Accordingly, the guide rail 57 is supported by the pair of side frames 55, in a state of leaving a spacing distance from the guide rail 56 on the front side of the guide rail 56 in the front-rear direction 8.

<Transmission Section 90>

A transmission section 90 shown in FIG. 10 is arranged in the printer section 11. The transmission section 90 transmits the driving force of one of the normal rotation and the reverse rotation (in the present embodiment, normal rotation) of the transporting motor 53 (refer to FIG. 6) to the transporting roller 60 as a driving force for transporting the recording paper 12 guided through the curved portion 33 of the transport path 65 in the transporting direction 15. On the other hand, the transmission section 90 transmits the driving force of the other of the normal rotation and the reverse rotation (in the present embodiment, reverse rotation) of the transporting motor 53 to the feeding roller 25 as a driving force for feeding the recording paper 12 supported by the feeding tray 20 to the curved portion 33 of the transport path 65.

As shown in FIG. 10, the transmission section 90 includes a first gear row 91 and a second gear row 92.

The first gear row 91 is provided for a maintenance base 95 which is arranged in a space 94 shown in FIG. 4 and FIG. 6. In FIG. 4 and FIG. 6, the maintenance base 95 is omitted. Here, the space 94 is formed on the right-side portion 72 of the base unit 70 at a position at which the recording head 38 can face the space 94. Moreover, the maintenance base 95 is a substantially box-shaped member as shown in FIG. 10, and has a maintenance unit (not shown in the diagram) arranged at an interior thereof. The maintenance unit prevents drying of the ink in the nozzles 39 of the recording head 38, and removes air bubbles and impurities from the nozzles 39 by suction. The description in detail of the maintenance unit is omitted here.

As shown in FIG. 10, the first gear row 91 includes a plurality of gears 97 fitted, respectively, in a plurality of shaft portions 96 which are formed on a left surface of the maintenance base 95, a gear 98 formed at a right-end portion of the spindle 28 of the feeding section 16, and a transmission switching gear 45 having a heretofore known one-way clutch (not shown in the diagram) at an interior, The gears 97, 98, and 45 form the first gear row 91 with the gears engaged mutually. The driving force is transmitted from the transporting roller 60 to the transmission switching gear 45 via a gear 37. Details of the transmission switching gear 45 will be described later.

The second gear row 92 includes a plurality of gears 99 rotatably supported by the feeding arm 26 of the feeding section 16. The gears 99 form the second gear row 92 with the gears 99 engaged mutually. The gear 99 arranged at the uppermost front side among the gears 99 is formed on the spindle 28 of the feeding section 16. Namely, the gear 99 at the uppermost front side is rotated integrally with the gear 98 in the first gear row 91. The gear 99 arranged at the lowermost rear side among the gears 99 is formed to be coaxial with the feeding roller 25.

In such manner, the transmission section 90 transmits the driving force transmitted from the transporting roller 60 to the feeding roller 25 via the first gear row 91 and the second gear row 92.

The transmission switching gear 45 includes a first gear 46 and a second gear 47. The first gear 46 and the second gear 47 are linked via the one-way clutch. Here, the first gear 46 is engaged with a drive gear 43 (that will be described later) via the gear 37. The second gear 47 is engaged with the gear 97.

As shown in FIG. 9, the transporting roller 60 extends up to an interior of the maintenance base 95 via a recess 100 formed in the maintenance base 95. Moreover, the drive gear 43 is formed at a right-end portion of the transporting roller 60. The drive gear 43 is engaged with the gear 37 shown in FIG. 10. Moreover, the first gear 46 of the transmission switching gear 45 is engaged with the gear 37. In other words, the transmission switching gear 45 is rotated by the driving force applied from the transporting motor 53 via the transporting roller 60 and the gear 37.

As mentioned above, the transmission switching gear 45 has the one-way clutch, The one-way clutch transmits the driving force of the first gear 46, which is rotated by the driving force of the reverse rotation of the transporting motor 53, to the second gear 47, but does not transmit the driving force of the first gear 46, which is rotated by the driving force of the normal rotation of the transporting motor 53, Co the second gear 47.

When the transporting motor 53 performs the reverse rotation, the driving force is transmitted to the feeding roller 25 from the transporting motor 53 via the transporting roller 60, the gear 37, and the transmission section 90. Accordingly, the feeding roller 25 is rotated and feeds the recording paper 12 to the curved portion 33. Whereas, when the transporting roller 53 performs the normal rotation, since the driving force of the first gear 46 is not transmitted to the second gear 47, the feeding roller 25 is not rotated. On the other hand, as mentioned above, when the transporting motor 53 performs the reverse rotation, the transporting roller 60 is rotated so that the recording paper 12 is transported in the direction opposite to the transporting direction 15, and when the transporting motor 53 performs the normal rotation, the transporting roller 60 is rotated so that the recording paper 12 is transported in the transporting direction 15.

When the recording paper 12 supported by the feeding tray 20 is fed by the feeding roller 25, the transporting motor 53 performs the reverse rotation, and when the recording paper 12 fed by the feeding roller 25 reaches the transporting roller 60, the transporting motor 53 is switched to perform the normal rotation from the reverse rotation. By doing this, the transporting by the transporting roller 60 and the feeding by the feeding roller 25 for the same recording paper 12 are prevented from being performed simultaneously.

The concrete arrangement of the transmission section 90 is not restricted to the arrangement described above, provided that, it is possible that the transmission section 90 transmits the driving force of one of the normal rotation and the reverse rotation of the transporting motor 53 to the transporting roller 60 as a driving force to transport the recording paper 12 guided through the curved portion 33 of the transport path 65 in the transporting direction, and that the transmission section 90 transmits, the driving force of the other of the normal rotation and the reverse rotation of the transporting motor 53 to the feeding roller 25 as a driving force to feed the recording paper 12 supported by the feeding tray 20 to the curved portion 33 of the transport path 65.

[Effect of the Embodiment]

According to the present embodiment, the base unit 70 is made of a resin. Therefore, it is possible to reduce an increase in cost of manufacturing the multi-function device 10.

Moreover, according to the present invention, the base unit 70 forms the inner-side guide 19. In other words, the inner-side guide 19 is formed integrally with the base unit 70. Therefore, in a state that a front-end portion in the transporting direction 15 of the recording paper 12 transported through the curved portion 33 reaches the transporting roller 60, and a rear-end portion in the transporting direction 15 of the recording paper 12 is abutted by the feeding roller 25, even in a case that the recording paper 12 is pulled in the transporting direction 15 by the transporting roller 60, and is pressed to the inner-side guide 19, it is possible to suppress shaking of the inner-side guide 19 to minimum, Moreover, the feeding section 16 is supported by the base unit 70 which forms the inner-side guide 19. Therefore, even if the inner-side guide 19 has been shaken, it is possible to suppress a change in a relative distance between the inner-side guide 19 and the feeding roller 25 within a dimensional tolerance of the inner-side guide 19 and the feeding roller 25. In other words, it is possible to reduce a position shift between the inner-side guide 19 which defines the inner side of the curvature of the curved portion 33 through which the recording paper 12 is transported, and the feeding roller 25 which feeds the recording paper 12 to the curved portion 33.

As it has been described above, according to the present embodiment, it is possible to maintain a favorable accuracy of transporting of the recording paper 12 which is transported through the curved portion 33 formed by the inner-side guide 19, while suppressing the manufacturing cost of the multi-function device 10 by making the base unit 70 of a resin material.

According to the present embodiment, since the transporting roller 60 is installed on the side frames 55 made of a metal, it is possible to maintain a favorable accuracy of position of the transporting roller 60.

On the other hand, since the transporting roller 60 is installed on the side frames 55, in the state that the front-end portion in the transporting direction 15 of the recording paper 12 transported through the curved portion 33 reaches the transporting roller 60 and the rear-end portion in the transporting direction 15 of the recording paper 12 is abutted by the feeding roller 25, if the recording paper 12 is pulled in the transporting direction 15 by the transporting roller 60, there is a possibility that the recording paper 12 relatively moves in the vertical direction 7 with respect to the inner-side guide 19 and the feeding roller 25. However, in the present embodiment, since the base unit 70 and the side frames 55 are fastened in the vertical direction 7 by the screws, it is possible to reduce the possibility of movement of the recording paper 12 in the vertical direction 7.

Moreover, according to the present embodiment, since the discharge roller 62 is supported by the side frames 55 made of a metal and the recording section is supported by the side frames 55 made of a metal via the guide rails 56 and 57, it is possible to maintain a favorable positioning accuracy of the discharge roller 62 and the recording section 24. As a result, it is possible maintain a favorable accuracy of transporting the recording paper 12 transported by the discharge roller 62, and a favorable quality of an image recorded on the recording paper 12 by the recording section 24.

Moreover, according to the present embodiment, while the transporting roller 60 is transporting the recording paper 12 guided through the curved portion 33, the feeding roller 25 does not feed the recording paper 12 supported by the feeding tray 20 to the curved portion 33. Therefore, in the state that the front-end portion in the transporting direction 15 of the recording paper 12 guided through the curved portion 33 reaches the transporting roller 60 and the rear-end portion in the transporting direction 15 of the recording paper 12 is abutted by the feeding roller 25, a situation in which the recording paper 12 is pulled in the transporting direction 15 by the transporting roller 60 is susceptible to occur. In other words, the present embodiment is a favorable arrangement for realizing the present invention. Moreover, according to the present embodiment, since it is possible to drive the transporting roller 60 and the feeding section 16 by the same transporting motor 53, it is possible to reduce the manufacturing and running cost of the multi-function device 10.

Moreover, according to the present embodiment, even in a case that the recording paper 12 is pulled by the transporting roller 60 in the transporting direction 15 and is adhered to the inner-side guide 19, the recording paper 12 is not susceptible to be adhered to outer sides in the left-right direction 9 of the inner-side guide 19 having small protrusions. In other words, it is possible to make an area, of the inner-side guide 19, to which the recording paper 12 is adhered. As a result, it is possible to reduce shaking of the inner-side guide 19.

Moreover, according to the present embodiment, since at least a part of the outer-side guide 18 is supported by the base unit 70, it is possible to position the outer-side guide 18.

What is claimed is:

1. A transporting apparatus comprising:
- a base unit made of a single resin material;
- a tray configured to support a sheet;
- a transporting section supported by an upper portion of the base unit and configured to transport the sheet; and
- a feeding section supported by a lower portion of the base unit and including a feeding roller configured to contact an upper surface of the sheet supported by the tray and to feed the sheet toward the transporting section;
- wherein the base unit forms an inner-side guide which defines an inner side of a curved path which is configured to guide the sheet fed by the feeding section to the transport section.

2. The transporting apparatus according to claim 1, further comprising:
- a first support portion disposed on the upper portion of the base unit and which is made of a metal;
- wherein the transporting section includes a transporting roller which is supported by the first support portion.

3. The transporting apparatus according to claim 2;
- wherein the base unit and the first support portion are fastened in a vertical direction by a fastener member.

4. The transporting apparatus according to claim 2, further comprising:
- a recording section configured to record an image on the sheet transported by the transporting section; and
- a second support portion supported by the first support portion and configured to support the recording section.

5. The transporting apparatus according to claim 4, further comprising:
- a discharge roller supported by the first support portion at a downstream position of the recording section in a transporting direction of the sheet and configured to transport the sheet.

6. The transporting apparatus according to claim 1, further comprising:
- a motor configured to perform a normal rotation and a reverse rotation; and
- a transmission section which is configured to transmit a driving force of one of the normal rotation and the reverse rotation of the motor to the transporting section as a driving force to transport the sheet that has been guided through the curved path, and which is configured to transmit a driving force of the other of the normal rotation and the reverse rotation of the motor to the feeding roller as a driving force to feed the sheet supported by the tray to the curved path.

7. The transporting apparatus according to claim 1, further comprising:

an outer-side guide disposed to face the inner-side guide and defining an outer side of the curved path;

wherein the inner-side guide includes:

a central portion; and outside portions located outside of the central portion in a width direction orthogonal to the transporting direction; and wherein the central portion is protruded toward the outer-side guide more than the outside portions.

8. The transporting apparatus according to claim 1, further comprising:

an outer-side guide disposed to face the inner-side guide and defining an outer side of the curved path;

wherein at least a part of the outer-side guide is supported by the base unit.

9. The transporting apparatus according to claim 8;

wherein the outer-side guide is configured to move between a first state and a second state; and wherein the outer-side guide is configured to define the outer side of curved path in the first state and expose the curved path to an exterior of the transporting apparatus in the second state.

10. The transporting apparatus according to claim 1;

wherein the feeding section further comprises an arm and a shaft potion;

wherein the arm is configured to rotatably support the feeding roller at a front-end portion of the arm;

wherein the shaft portion is provided for a base-end portion of the arm and configured to support the arm swingably; and wherein the shaft portion is rotatably supported by the lower portion of the base unit.

11. The transporting apparatus according to claim 1;

wherein the inner-side guide includes a plurality of ribs protruding from a surface of the inner-side guide toward an outer side of the curved path.

12. The transporting apparatus according to claim 1, further comprising:

an outer-side guide disposed to face the inner-side guide and defining an outer side of the curved path;

wherein the inner-side guide includes:

a first guide portion located at a position corresponding to the feeding roller with respect to a width direction orthogonal to the transporting direction; and a second guide portion located outside of the first guide portion with respect to the width direction; and wherein the first guide portion is protruded toward the outer-side guide more than the second guide portion.

13. A transporting apparatus comprising:

a tray configured to support a sheet;

a feeding section including a feeding roller configured to contact an upper surface of the sheet supported by the tray and to feed the sheet;

a transporting section configured to transport the sheet which is fed by the feeding section; and a base unit made of a single resin material and configured to support the feeding section and transporting section;

wherein the base unit forms an inner-side guide which defines an inner side of a curved path which is configured to guide the sheet fed by the feeding section to the transport section.

* * * * *